US005662166A

United States Patent [19]

Shammai

[11] Patent Number: 5,662,166

[45] Date of Patent: Sep. 2, 1997

[54] APPARATUS FOR MAINTAINING AT LEAST BOTTOM HOLE PRESSURE OF A FLUID SAMPLE UPON RETRIEVAL FROM AN EARTH BORE

[76] Inventor: Houman M. Shammai, 411 Robinhood Cir., Lafayette, La. 70508

[21] Appl. No.: 546,663

[22] Filed: Oct. 23, 1995

[51] Int. Cl.[6] ..... E21B 47/00

[52] U.S. Cl. ..... 166/264; 166/373; 166/169

[58] Field of Search ..... 166/264, 64, 373, 166/169, 250.01, 66.7

[56] References Cited

U.S. PATENT DOCUMENTS

| | | | |
|---|---|---|---|
| 4,665,983 | 5/1987 | Ringgenberg | 166/250.01 |
| 4,856,585 | 8/1989 | White et al. | 166/250.01 |
| 4,903,765 | 2/1990 | Zunkel | 166/162 |
| 4,915,171 | 4/1990 | McMahan | 166/264 |
| 5,058,674 | 10/1991 | Schultz et al. | 166/264 |
| 5,337,822 | 8/1994 | Massie et al. | 166/264 |
| 5,494,102 | 2/1996 | Schulte | 166/105.6 |

*Primary Examiner*—Frank Tsay
*Attorney, Agent, or Firm*—Jesse D. Lambert

[57] ABSTRACT

The apparatus includes an elongated tubular body having, in longitudinally consecutive array, a sample chamber, a pressurized gas reservoir, and an evacuate reservoir. A piston, having at least two pressure activated seals disposed in opposition, is longitudinally movable in the sample chamber. An elongated spool having a longitudinal bore and outer circumference lands and grooves, is longitudinally slidable between seated bores disposed in longitudinally opposite sides of the pressurized gas reservoir thereby providing on activation a unitary means for establishing a specific sequence of liquid and gas transfer between said chambers and reservoirs.

The apparatus is prepared for use by positioning of the piston proximal to a checked influent valve, charging the distal end of the sample chamber with an incompressible fluid, charging of the pressurized gas chamber with a compressible gas, and charging of a time delay apparatus. The apparatus is then lowered in the earth bore. On expiry of the time delay the incompressible fluid is bled into the evacuate reservoir, allowing the piston to move distally and uptake work sample. Terminal piston travel begins moving the elongated spool, initiating a cascade of events in desired sequence. Initial spool movement discharges pressurized gas against a land of the spool, moving the spool forcefully to first close further liquid bleed from the sample chamber then charge the sample chamber with pressurized gas. The apparatus is then retrieved from the earth bore and work sample therein discharged directly into pressurized testing and/or pressurized storage apparatus.

8 Claims, 5 Drawing Sheets

APPARATUS FOR MAINTAINING AT LEAST BOTTOM HOLE PRESSURE OF A FLUID SAMPLE UPON RETRIEVAL FROM AN EARTH BORE

BACKGROUND OF THE INVENTION

1. Field of the Invention

This present invention relates to apparatus used to retrieve downhole samples of reservoir fluids from earth bores. With more particularity, the present invention relates to apparatus used to secure subsurface samples of fluids at a pressure at least as great as that of the reservoir pressure at the level at which the sample was found. With further particularity, the present invention relates to sampling apparatus designed to lower downhole, capture a pressurized fluid sample downhole and maintain at least downhole pressure of said sample as the sampling apparatus (and sample therein) is subjected to cooling during retrieval and transfer to pressurized laboratory testing or storage device.

2. Description of the Related Art

Petroleum reservoir fluids, particularly oils, vary greatly in their physical properties from reservoir to reservoir. Properties such as composition, viscosity, gaseous phase envelope and solid phase envelope greatly affect the potential value of a reservoir. These properties affect whether production may be economically achieved at all and, if so, the duration, expense and per unit price of said production. For this reason securing very accurate oil samples, for detailed testing, is of key importance.

Various methods exist to take oil samples. One method is to take samples of the produced oil and gas streams at the surface, combine the oil and gas in a manner believed to create a recombinant sample as it exists in the reservoir, and perform tests on the recombinant. Petroleum reservoirs are usually several thousands of feet from the earth's surface and typically have pressures of several thousands of pounds per square inch and temperatures on the order of 250 degrees Fahrenheit or more. However, substantial inaccuracies may occur in testing of recombined samples, as several, irreversible changes may have already occurred during flow of the downhole fluid to the surface. During flow of downhole fluid to the surface both pressure and temperature drop dramatically. Such changes may cause certain components of the downhole fluid to irreversibly precipitate from solution and/or colloidal suspension and thereby be underestimated from surface sampling. Such downhole changes, such as paraffin or asphaltene deposition, could nevertheless be causing substantial downhole damages to the well. Such damage might have been entirely avoidable, if accurate testing had shown the precise composition, pressure and temperature of their formation.

An improvement is subsurface sampling. While subsurface oil sampling is preferred so as to secure a more representative sample of downhole composition and thereby increase the accuracy of the test results, preventing irreversible changes in the work sample during retrieval to surface and discharge into pressurized test or storage devices has remained problematic. Early sample tools employed a fixed volume, initially evacuated chamber, that was lowered to the formation desired to be sampled, where a valve was opened to allow inflow of oil into the chamber. Once filled, the valve was closed, retaining the sample, and the chamber was brought to the surface. During retrieval of the sample tool to the surface, cooling of the sample, in a fixed volume, resulted in a sample pressure decrease. Decreased pressure often resulted in gasification of certain fractional components as well as irreversible precipitation of certain solid components. While very careful laboratory studies could be conducted on at least a partially recombined sample, and further testing could be performed on components irreversibly separated from the original sample, there persisted a margin of possible inaccuracy which was sometimes critical to very valuable producing properties. As those skilled in the art know some producing properties can be problematic and expensive to shut-in for cleaning or reworking and may be difficult, if not impossible, to restore to production following rework.

Efforts to limit or prevent phase change of samples during retrieval and transport to laboratory or pressurized storage devices have resulted in variable-volume sample chamber tools of two broad groups:

A. Tools having a sample chamber made variable in volume by inclusion of an internal reservoir of elastic volume therein.

B. Tools having a sampling chamber made variable in volume by means of a pressurized incompressible fluid. An elastic means, such as gas or a spring, is typically used to pressurize said incompressible fluid, either directly or through a second piston.

Whitten, U.S. Pat. No. 3,859,850 (Jan. 14, 1975), Bimond, et al, GB 2012722 A (1979), Petermann, U.S. Pat. No. 4,766,955 (Aug. 30, 1988), and Gruber, et al, U.S. Pat. No. 5,009,100 (Apr. 23, 1991), all disclose subsurface sample tools that employ a sample chamber of the nature of tools described in group (A) above. A reservoir of trapped gas is included in the sample chamber. The volume of said reservoir is, essentially, made elastic by means of a piston which may be compressed internally (when pressure outside of the reservoir is greater than internal pressure of the reservoir). As the sample tool is lowered downhole the reservoir of trapped gas, if lower in pressure than downhole pressure, decreases in volume (a piston in the reservoir is forced inward). In theory, on cooling and contraction of the sample (as by retrieval to the surface), the gas in the reservoir will re-expand and maintain pressure of the sample. However, in order for the volume of the reservoir of trapped gas to contract upon descent downhole (and therefore be capable of re-expanding on retrieval) its initial pressure must be something less than bottom hole pressure of the sample. Additionally, as the sample cools on retrieval, so does the trapped gas, further reducing the ability of the trapped gas to re-expand fully from downhole conditions. Thus, while tools of group (A) may be of some utility, at least for the purpose of limiting the amount of pressure losses in a fluid upon retrieval from downhole, they are inherently incapable of maintaining the sample at or above downhole pressure condition during retrieval. Such tools also fail to disclose leakproof piston seal design, and the possibility of gas leakage is mentioned in Bimond et al. In order to detect and account for such leakage Bimond et al. teaches the use of a tracer gas, such as carbon tetrafluoride, which is not found in the sample.

As alternatives to the tools of group (A) are tools of group (B) such as McConnachie, GB 2022554 A and Massie, et al, U.S. Pat. No. 5,337,822 (Aug. 16, 1994). These tools represent an improvement to the tools of group (A) in the sense that both have the capability of retrieving a sample while maintaining a sample pressure at or above original down hole pressure. Despite at least the possibility of improved performance both tools, however, utilize an incompressible fluid to drive, either directly or indirectly, against a trapped volume of sampled fluid. A piston is utilized to pressurize the incompressible fluid. Said piston is powered by an elastic source such as a gas or a spring.

McConnachie, GB 2022554 A, discloses a subsurface flow-through sampling tool. As the sampler descends in the well, oil enters and exits the sample chamber through flow-through ports. Once at the desired depth, oil is trapped in the tool by a sliding dual piston means. Valve means then releases a pressurized gas, driving a piston that displaces mercury under pressure into the sample chamber. The resulting sequence of pressure transmission forces to maintain pressure on the sample is: pressurized gas—piston—mercury—oil sample.

Massie, et al, U.S. Pat. No. 5,337,822 (Aug. 16, 1994) employs a sample chamber divided by a movable piston. Said piston is pressurized against the sample by an incompressible fluid such as mineral oil. The mineral oil is, in turn, pressurized by a movable piston contained in a second chamber. The movable piston of the second chamber is, in turn, driven by an elastic source, such as a spring or a gas in said second chamber. The resulting sequence of pressure transmission forces to maintain pressure on the sample is: elastic source—second piston—incompressible fluid—first piston—oil sample. The Massie tool employs numerous parts and relies on a lengthy sequential operation of multiple valves with the attendant chance of malfunction. Accordingly each of the aforesaid sampling tools designs are either limited in performance or inherently complex, costly, likely to require substantial maintenance and/or are prone to malfunction.

It is therefore the principal object of the present invention to provide an improved tool for taking of downhole samples of fluids in an earth bore. A particular object of the invention is to provide a downhole sampling tool capable of maintaining pressure of the sample at, or above, downhole pressure during retrieval of the sample to surface, despite thermal contraction of the sample by virtue of cooling upon retrieval. With greater particularly an object of the present invention is to provide a downhole sampling tool of simple, efficient, reliable and inexpensive design characteristics. Specific objects of the invention are to provide a downhole sampling tool accomplishing the above listed objectives, which further embodies use of only one piston in its pressure charging circuit; eliminates the use of a piston-incompressible fluid-piston segment in its pressure charging circuit; has a simplified valve means which switches from a filling mode to a pressurization mode by shifting of a single control spool; and has a minimal number of movable parts cooperating in a simple operational sequence to delay filling until downhole, automatically fill with sample when desired, and maintain the pressure of said sample at or above downhole pressure despite thermal contraction of the sample on retrieval to the surface.

SUMMARY OF THE INVENTION

The apparatus for downhole sampling of a fluid in an earth bore, according to the present invention, is characterized by an elongated tubular body having in longitudinal array a sample chamber, a pressurized gas reservoir, and an evacuate reservoir. Disposed in the sample chamber is a piston axially movable between an inlet valve and the pressurized gas reservoir. On entry into a well the piston of the sample chamber is disposed adjacent to the inlet valve of the sample chamber and hydraulically locked in said position by means of an incompressible fluid. On expiry of a time delay device a first valve means is operated (by said time delay device) to release the hydraulic lock (the incompressible fluid then bleeding into the evacuate chamber). Bleeding of the hydraulic lock through the first valve means allows sample, under pressure, to flow into the sample chamber. Filling of the sample chamber with sample fluid moves the piston of the sample chamber towards the pressurized gas reservoir. Terminal movement of the piston operates an elongated spool to first cause pressurized gas to act upon a land on said spool, causing further spool movement, and this further spool movement causes the first valve means to close, then causes pressurized gas to drive against the side of the piston opposite to the sample.

DESCRIPTION OF THE PREFERRED EMBODIMENT

Figure 1:
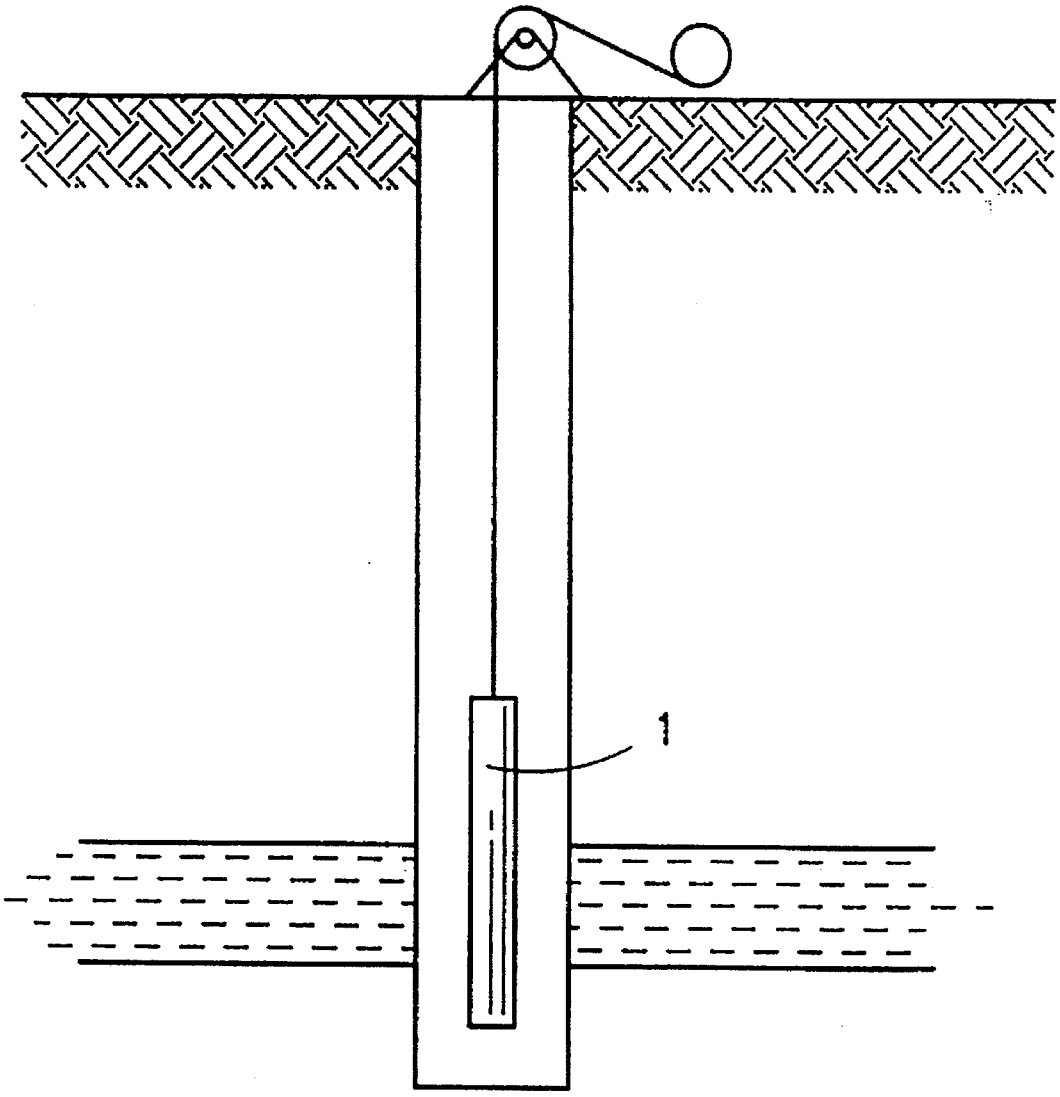
FIG. 1 is a cross section of a typical earth borehole showing the apparatus in place for sampling an oil reservoir.

FIG. 1 merely illustrates insertion of a sampling tool into an earth bore to capture fluid of a down hole formation. While there may be various embodiments of the present invention, with reference to FIGS. 2 to 9, the preferred embodiment is described herein.

Figure 2:
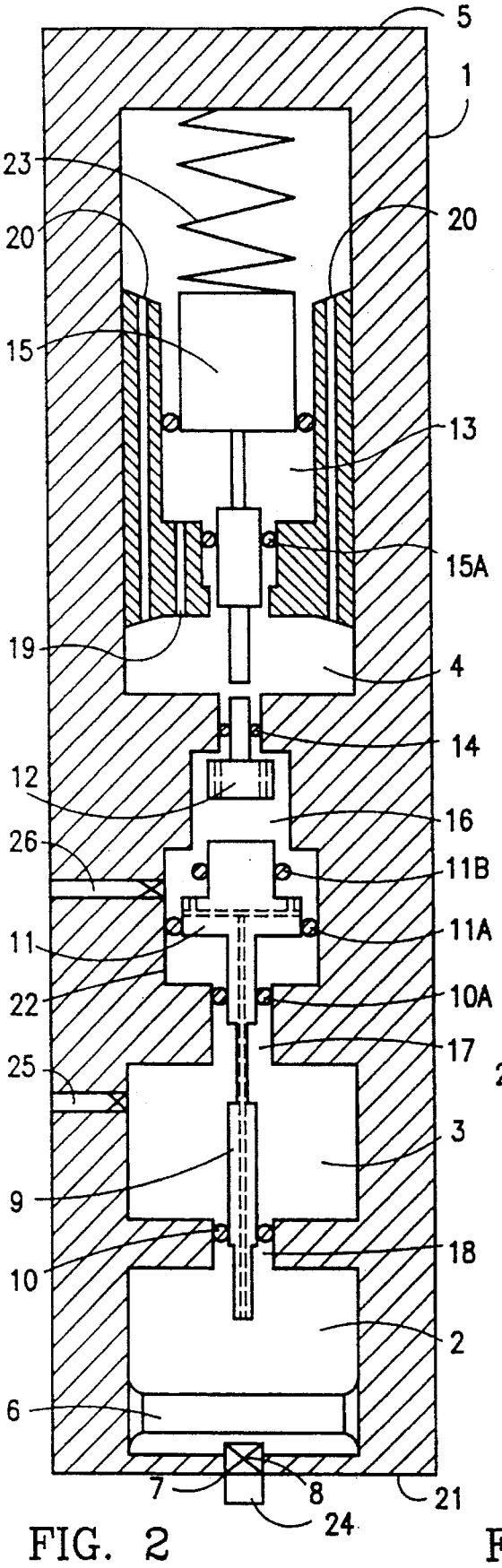
FIG. 2 is a detailed schematic of the apparatus in cross section, prior to commencing inflow of the oil sample.

FIG. 2 shows the apparatus as in position in a borehole in preparation to take an oil sample, before the sample has started to enter the sample chamber. As seen in FIG. 2, the apparatus comprises an elongated tubular body 1 having a first end 21, a sample chamber 2, a pressurized gas reservoir 3, an evacuate reservoir 4, and a second end 5 in a consecutive longitudinal array. First, second, and third valve means 16, 17, and 18 are disposed between the chamber and the reservoirs. A sample inlet port 7 is in the first end 21 of said elongated tubular body 1, with a unidirectional inlet valve 8 in the port, to permit inflow of an oil sample into the sample chamber, and a sample filter means 24 to prevent solids, such as formation sand, from entering the sample chamber.

A sample piston 6 (shown in further detail in FIG. 7) is sealingly disposed in sample chamber 2 between sample inlet port 7 and third valve means 18, proximal to first end 21 of said elongated tubular body 1, piston 6 moveable bi-directionally in sample chamber 2. Elongated spool 9 spans pressurized gas reservoir 3 placing sample chamber 2 and evacuate reservoir 4 in fluid communication. Elongated spool 9 is operatively coupled to first, second, and third valve means 16, 17, and 18, for operation as will be described in detail. Prior to sample inflow, elongated spool 9 protrudes into sample chamber 2, as shown in FIG. 2.

First valve means 16 comprises valve bore 22, first plunger 12, seal 14, land 11, and seals 11A and 11B. Seals 11A and t t B are about the circumference of land 11 to seal land 11 in different parts of valve bore 22, as described in further detail below. Second valve means 17 comprises seal 10A and groove 9B of elongated spool 9. Third valve means 18 comprises seal 10 and groove 9C of elongated spool 9.

A time delay device comprises spring 23 and thrust member 15. Evacuate reservoir 4 comprises a thrust member guide section having seals 15A within. Evacuate reservoir 4 further comprises adjustable area orifice 19 and hydraulic fluid channels 20, as shown in further detail in FIG. 9. Evacuate reservoir 4 should initially be at a pressure sufficiently below pressure of the reservoir to be sampled and remain substantially below said reservoir pressure even after a volume of incompressible fluid equal to the volume of the sample chamber has bled into said evacuate reservoir. While a spring is shown in the preferred embodiment, the time delay device may be powered by other suitable means. In the preferred embodiment of the invention hydraulic fluid initially fills the volume 13. The time delay device may be set by adjusting the area of orifice 19 to drive thrust member 15 at a preselected delay time.

Sample piston 6 divides sample chamber 2 into a front section proximal to first end 21 and a back section proximal to pressurized gas reservoir 3. A hydraulic fluid, substantially non-compressible, fills said back section of sample chamber 2 upon assembly of the apparatus. A pressurized gas fills pressurized gas reservoir 3. This gas may be pressured to a desired pressure typically but not necessarily above the expected reservoir pressure.

Figure 6:
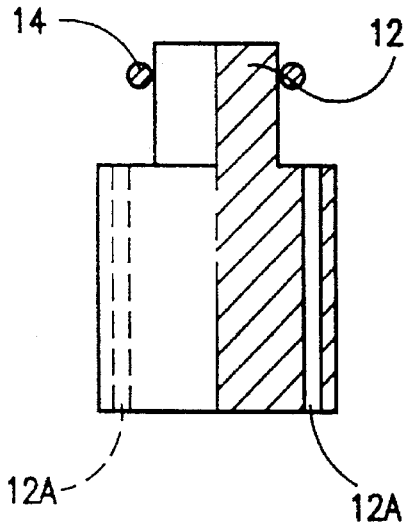
FIG. 6 is a detailed schematic in partial cross section of the first plunger of the first valve means.

FIG. 6 shows first plunger 12 in greater detail, in partial cross-section, including seal 14 and fluid channels 12A for passage of hydraulic fluid during the operation of the apparatus, as will be described in further detail below.

Figure 7:
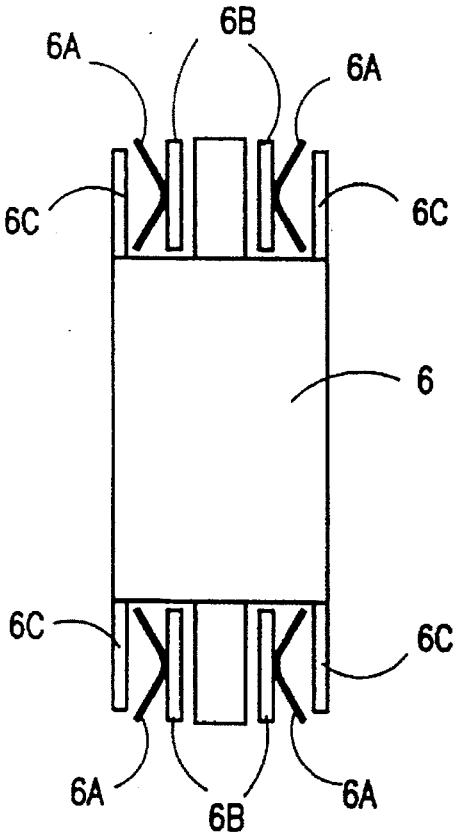
FIG. 7 is a detailed schematic in cross section of the sample piston.

FIG. 7 shows sample piston 6 in greater detail. Sample piston 6 comprises at least two counter-opposed pressure-activated seals 6A. Backup rings 6B, and retaining rings 6C and seals 6A preclude passage of fluid, liquid or gaseous, from one section of the sample chamber to the other.

Figure 8:
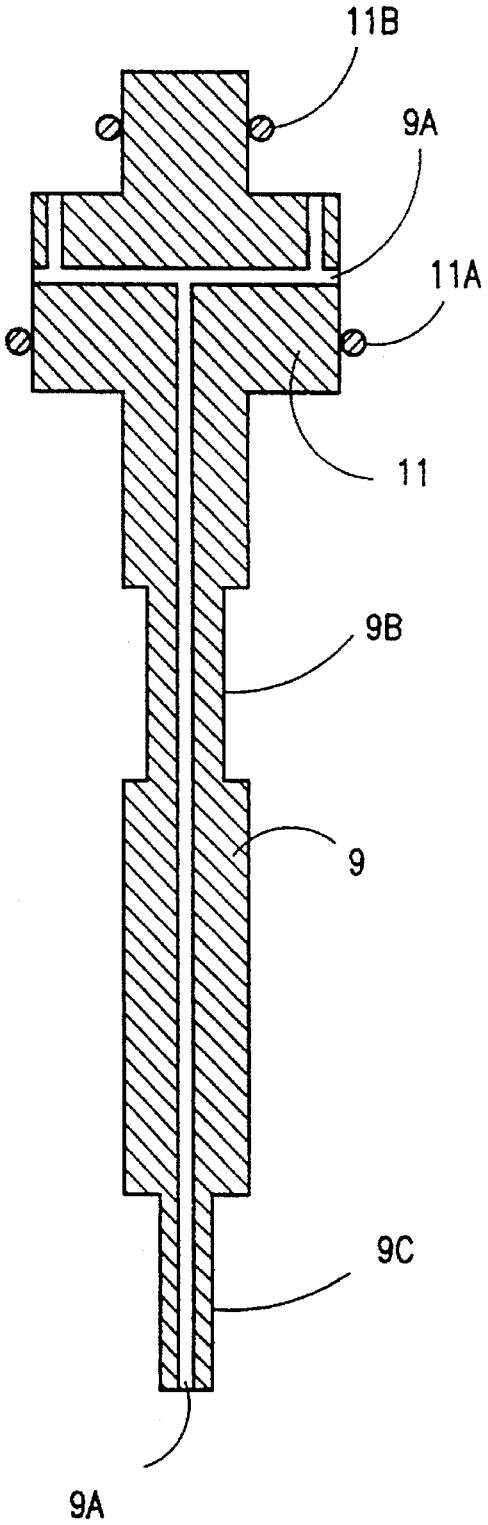
FIG. 8 is a detailed schematic in cross section of the elongated spool.

FIG. 8 shows elongated spool 9 in cross section detail, showing bore 9A, groove 9B, and groove 9C. FIG. 8 further shows elongated spool 9 coupled to land 11, comprising the first valve means 16, and seals 11A and 11B.

Figure 9:
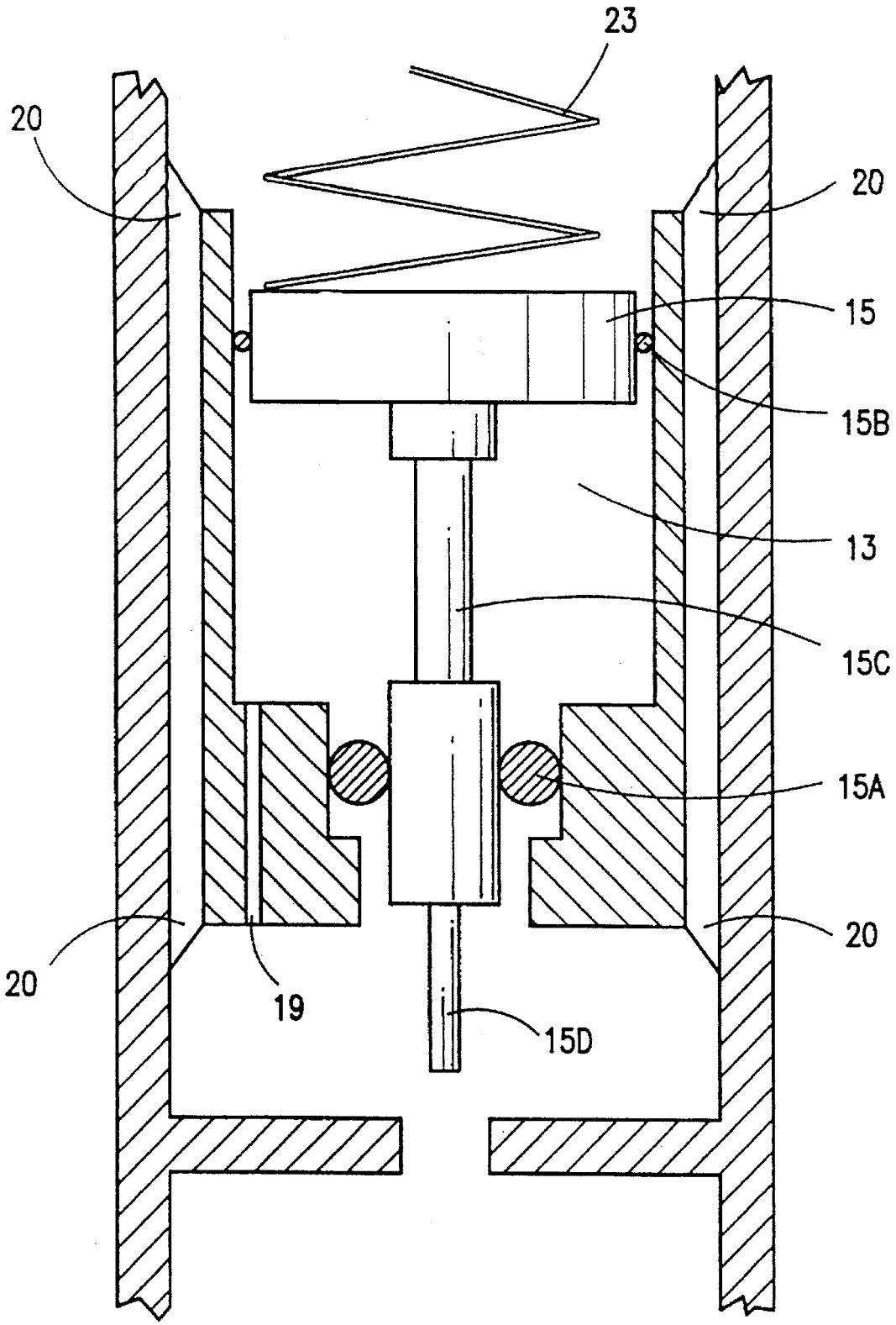
FIG. 9 is a detailed schematic in partial cross section of one embodiment of the time delay device.

FIG. 9 shows the time delay device in detail. Spring 23 drives thrust member 15. Thrust member 15 has extended nose 15D and a central reduced diameter shaft section 15C. Seals 15A and 15B seal thrust member 15 within a thrust member guide section of evacuate reservoir 4, with seal 15B attached to thrust member 15 and seal 15A disposed between thrust member 15 and thrust member guide section of evacuate reservoir 4. A hydraulic fluid initially fills volume 13. Once spring 23 is placed into compression, "cocking" the tool, spring 23 drives thrust member 15 forward. Thrust member 15 movement is controlled by the rate of flow of the hydraulic fluid from volume 13 through orifice 19 into evacuate reservoir 4. The flow area of orifice 19 may be adjusted to adjust the rate of fluid flow therethrough. The hydraulic fluid then passes, as necessary, through channels 20 into another portion of evacuate reservoir 4. When reduced diameter section 15C passes seal 15A, flow area available to the hydraulic fluid is greatly increased, being that annular area around reduced diameter section 15C in addition to orifice 19. The result is a rapid thrust forward of thrust member 15, with nose 15D striking first plunger 12 and forcing it out of its initial sealing position in valve bore 22, opening first valve means 16 and commencing sampling, as will be further described herein.

Before operation of the apparatus, a gas, preferably substantially inert, such as nitrogen, is introduced to the pressurized gas reservoir 3 via charge port 25 to obtain a suitable pressure, typically (but not necessarily) 1000 psi to 2000 psi above reservoir pressure. Hydraulic fluid is pumped into the apparatus through charge port 26 until sample chamber 2, bore 9A, and valve bore 22 are preferably pressurized to near the anticipated reservoir pressure. Evacuate reservoir 4 may be initially at least partially evacuated so that it will remain below reservoir pressure even after uptake of incompressible fluid from the timer device and the sample chamber.

Figure 3:
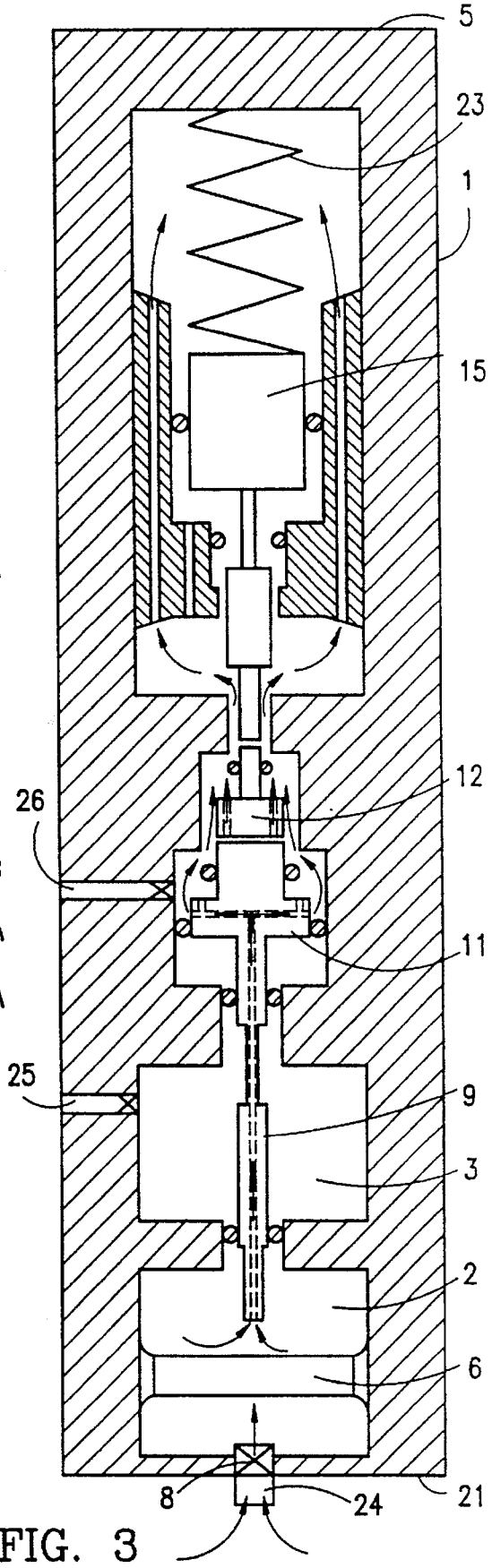
FIG. 3 is a detailed schematic in cross section, while an oil sample is flowing into the tool.

The operation of the apparatus of the present invention is now described. FIG. 3 shows the apparatus while sample fluid is flowing into the sample chamber. Spring 23 drives thrust member 15 forward, unseating first plunger 12 at a preselected time, as described in detail above. First valve means 16 is then open and evacuate reservoir 4 and sample chamber 2 are then in fluid communication through bore 9A. A pressure differential is then in place across sample piston 6, with reservoir pressure on one side of sample piston 6 greater than the evacuate reservoir 4 pressure on the other side of piston 6. Piston 6 then begins to move in response to this pressure differential, with an oil sample entering sample chamber 2 through the unidirectional inlet valve 8 and sample filter 24 in sample inlet port 7. The rate of sample inflow is controlled by the flow restrictions encountered by the hydraulic fluid being displaced by the piston 6 and flowing through bore 9A, channel 12A in first plunger 12, and flow channels 20. In addition, bore 9A may include an orifice to regulate hydraulic fluid flow. The arrows in FIG. 3 illustrate the flow path of the hydraulic fluid as described, from the sample chamber 2 ultimately into evacuate reservoir 4.

Figure 4:
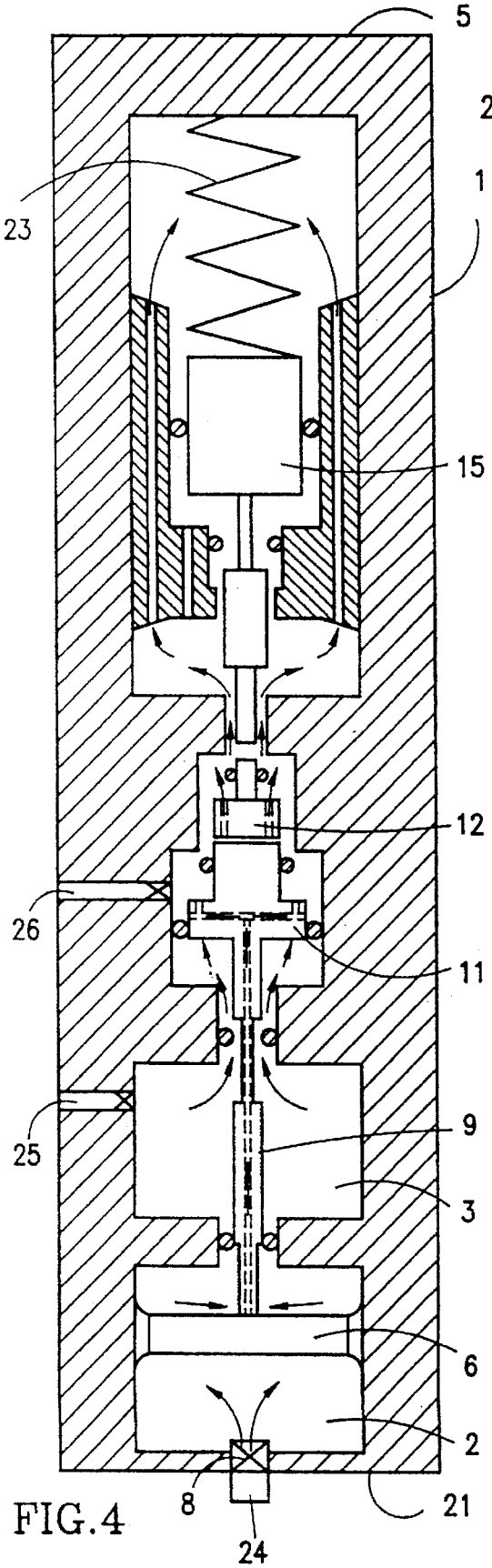
FIG. 4 is a detailed schematic in cross section, while oil sample inflow is continuing and after gas pressure has begun to move the elongated spool preparatory to closing the first valve means.

The next stage of operation of the apparatus is shown in FIG. 4. In FIG. 4, sample piston 6 has partially displaced elongated spool 9 out of sample chamber 2. This movement of elongated spool 9 places groove 9B opposite seals 10A, opening second valve means 17. Pressurized gas from pressurized gas reservoir 3 now flows into valve bore 22 to act upon land 11. Elongated spool 9 is at this time being pushed by piston 6 and pulled by gas pressure on land 11. Third valve means 18 is still closed at this point.

Figure 5:
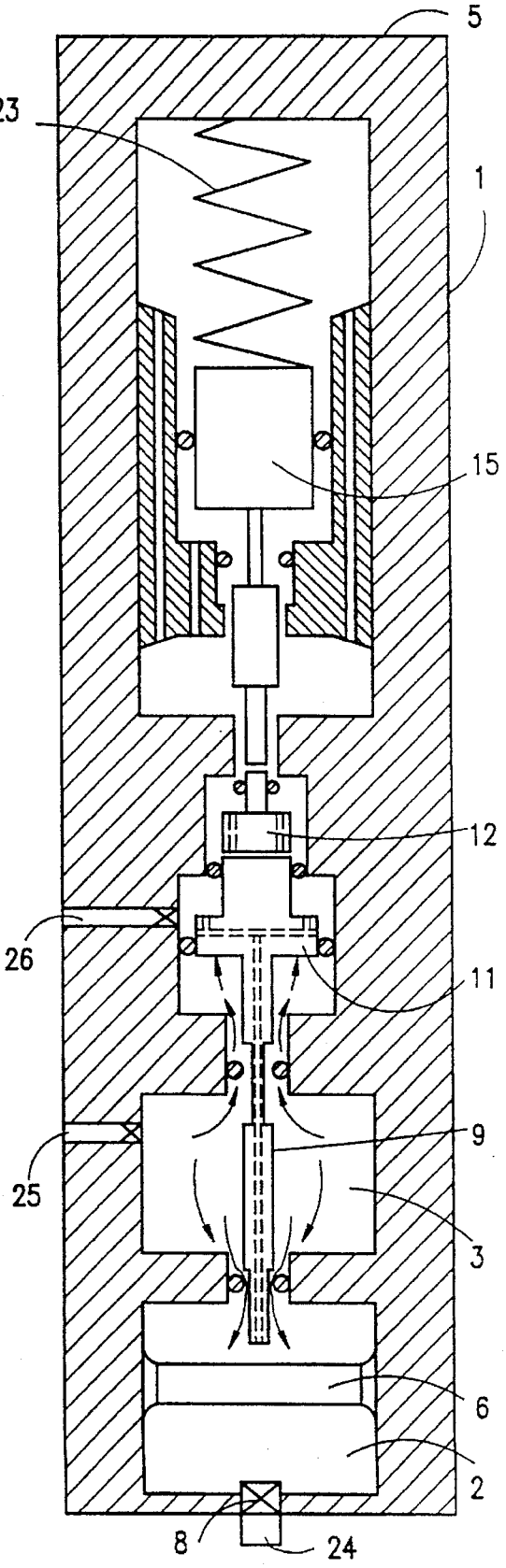
FIG. 5 is a detailed schematic in cross-section after sample inflow has been halted and gas pressure applied to the sample piston.

FIG. 5 shows the apparatus of the present invention after sample inflow has ceased and pressurized gas is applied to sample piston 6. Land 11, driven by gas pressure, is moved so that seal 11B is sealingly in place in valve bore 22 and first valve means 16 is thereby closed. This prevents any further fluid flow from sample chamber 2. After first valve means 16 closes, further movement of land 11 in response to gas pressure, and consequently movement of elongated spool 9, brings groove 9C across from seal 10, opening third valve means 18. Gas pressure from pressurized gas reservoir 3 acts directly on sample piston 6, forcing it against the oil now contained in sample chamber 2. The unidirectional valve 8 prevents escape of the sample from the sample chamber.

The gas in pressurized gas reservoir 3 may be pressured to any desired pressure, with the preferred embodiment contemplating an initial charge pressure 1000 psi to 2000 psi above expected reservoir pressure. As the apparatus of the present invention is withdrawn from the borehole at the formation depth, the temperature of the apparatus and the pressurized gas and sample will decrease. A result will be a contraction of the oil sample volume and the pressurized gas volume. A gas pressure sufficiently higher than the original reservoir pressure ensures that the sample remains in single phase.

Various other uses and modifications of the present invention will occur to those skilled in the art. For example, the apparatus could be used to take samples of reservoir fluids other than single phase oil, such as gas and formation water, when it is important that the pressure-dependent properties of these fluids be preserved.

Accordingly, the foregoing description should be regarded as only illustrative of the invention, whose full scope is measured by the following claims.

I claim:

1. A downhole sampling tool, comprising:

a sample chamber having an axially slidable piston disposed therein, said piston dividing said sample chamber into a front section and a back section, said piston maintaining pressure of a fluid sample contained in said front section during retrieval of the sampling tool by release of an elastic gas directly to said back section while said sampling tool is downhole, said elastic gas at a pressure at least as great as the downhole pressure of the fluid sample.

2. The downhole sampling tool of claim 1, wherein said piston has at least two pressure activated seals disposed in opposing directions.

3. The downhole sampling tool of claim 1 or 2, wherein said sampling chamber further comprises an inlet port and said piston is hydraulically locked in a position proximal to said inlet port until the sampling tool reaches a desired downhole position.

4. The downhole sampling tool of claim 3, wherein release of fluid comprising the hydraulic lock is initiated by a time delay device.

5. The downhole sampling tool of claim 1, wherein, after admission of said fluid sample to said front section of said sample chamber, said back section of said sampling chamber is first sealed against release of fluid then pressurized with an elastic gas by axial movement of an elongated spool, which said axial movement of said spool is caused by contact with said piston, which said piston is driven by the pressure of the sampling fluid.

6. An apparatus for maintaining at least bottom hole pressure of a fluid sample upon retrieval from an earth bore, comprising:

a) an elongated tubular body having in longitudinal sequence a first end, a sample chamber, a pressurized gas reservoir, a evacuate reservoir, and a second end, a sliding sample piston sealingly disposed in said sample chamber dividing said sample chamber into a front section and a back section, said front section of said sample chamber disposed proximally to said first end of said elongated tubular body and having a sample inlet port proximal to said first end of said tubular body for permitting fluid flow into said front section of said sample chamber;

b) a first valve means for controlling flow from said back section of said sample chamber to said evacuate reservoir;

c) an elongated spool having an axial bore, ends, circumferential lands and circumferential grooves, said axial bore of said elongated spool hydraulically connecting said back section of said sample chamber and said evacuate reservoir, said elongated spool axially movable upon contact by said sample piston proximate to said pressurized gas reservoir, said lands and grooves cooperatively engaging axial bores disposed at opposite ends of said pressurized gas reservoir to form second and third valve means, the relative positions of said ends, lands and grooves causing a specific operational sequence to occur upon axial movement of said elongated spool, said specific operational sequence being: on axial movement of said elongated spool in a direction away from said first end of said elongated body said second valve means is first opened, said first valve means is then closed, and, said third valve means is then opened;

d) second valve means for controlling flow of pressurized gas from said pressurized gas reservoir to said first valve means, said second valve means operationally coupled to axial movement of said elongated spool;

e) third valve means for controlling flow of pressurized gas from said pressurized gas reservoir to said back section of said sample chamber, said third valve means operationally coupled to axial movement of said elongated spool; and, f) time delay means for opening said first valve means.

7. The apparatus of claim 6, wherein said sample piston comprises at least one pressure activated seal responsive to pressure from one side of said piston and at least one pressure activated seal responsive to pressure from the other side of said piston.

8. The apparatus of claim 6, wherein:

said time delay means comprises a spring biased thrust member in sliding disposition within a thrust member guide section; and said thrust member is sealingly disposed in said thrust member guide section with first and second seal means, defining a chamber having a volume, said thrust member guide section further having an orifice therein permitting controlled flow of a fluid from said chamber in response to a force from said thrust member.

* * * * *